US009771236B2

(12) United States Patent
Otsu et al.

(10) Patent No.: US 9,771,236 B2
(45) Date of Patent: Sep. 26, 2017

(54) SHEET-PROCESSING APPARATUS THAT FOLDS A SHEET, AND IMAGE-FORMING SYSTEM USING THE SAME

(71) Applicant: KONICA MINOLTA, INC., Chiyoda-ku, Tokyo (JP)

(72) Inventors: Shohei Otsu, Tokyo (JP); Hirofumi Nakajima, Tokyo (JP); Teruhiko Toyoizumi, Tokyo (JP); Takumi Shirakuma, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 205 days.

(21) Appl. No.: 14/696,094

(22) Filed: Apr. 24, 2015

(65) Prior Publication Data

US 2015/0336763 A1 Nov. 26, 2015

(30) Foreign Application Priority Data

May 26, 2014 (JP) ..... 2014-108343

(51) Int. Cl.
*B65H 45/16* (2006.01)
*B65H 45/18* (2006.01)
(Continued)

(52) U.S. Cl.
CPC ..... *B65H 45/16* (2013.01); *B42C 5/00* (2013.01); *B42C 19/02* (2013.01); *B65H 5/32* (2013.01);
(Continued)

(58) Field of Classification Search
CPC ..... B65H 37/06; B65H 45/18; B65H 45/147; B65H 2801/27
(Continued)

(56) References Cited

U.S. PATENT DOCUMENTS 7,673,863 B2 3/2010 Iguchi et al.
7,926,799 B2 * 4/2011 Iguchi ..... 270/45
(Continued)

FOREIGN PATENT DOCUMENTS

JP 06316364 A 11/1994
JP 2007076832 A 3/2007
(Continued)

OTHER PUBLICATIONS

Japanese Office Action (and English translation thereof) dated Mar. 8, 2016, issued in Japanese Application No. 2014-108343.

*Primary Examiner* — Leslie A Nicholson, III
(74) *Attorney, Agent, or Firm* — Holtz, Holtz & Volek PC

(57) ABSTRACT

In a saddle-stitching apparatus, when a sheet is transported to a center-folding unit, a folding blade moves from a retrieved position to a nip position between a pair of folding rollers. A forward end of the folding blade comes into contact with a fold of the sheet, so that the sheet is folded along the fold. When the sheet is attached to the nip position between the folding rollers, the folding rollers start rotating and then, the folding blade inserts the center-folded sheet between the folding rollers. After the center-fold finishing is completed, the rotations of the folding rollers stop in timing at which the folding blade is pulled out of the nip position between the folding rollers. When pulling the folding blade out of the nip position between the folding rollers, the rotations of the folding rollers restart.

12 Claims, 7 Drawing Sheets

(51) Int. Cl.

| | |
|---|---|
| ***B65H 45/30*** | (2006.01) |
| ***B65H 43/00*** | (2006.01) |
| ***B65H 37/06*** | (2006.01) |
| ***B42C 5/00*** | (2006.01) |
| ***B42C 19/02*** | (2006.01) |
| ***B65H 37/04*** | (2006.01) |
| ***B65H 5/32*** | (2006.01) |

(52) U.S. Cl.
CPC ..... *B65H 37/04* (2013.01); *B65H 37/06* (2013.01); *B65H 43/00* (2013.01); *B65H 45/18* (2013.01); *B65H 45/30* (2013.01); *B65H 2301/322* (2013.01); *B65H 2511/10* (2013.01); *B65H 2511/13* (2013.01); *B65H 2511/30* (2013.01); *B65H 2513/108* (2013.01); *B65H 2513/222* (2013.01); *B65H 2513/512* (2013.01); *B65H 2515/112* (2013.01); *B65H 2557/242* (2013.01); *B65H 2701/182* (2013.01); *B65H 2801/27* (2013.01)

(58) Field of Classification Search
USPC ..... 270/32; 493/435, 444, 445
See application file for complete search history.

(56) References Cited

U.S. PATENT DOCUMENTS

| | | | | |
|---|---|---|---|---|
| 7,997,569 | B2 * | 8/2011 | Iguchi et al. ..... | 270/37 |
| 8,028,980 | B2 * | 10/2011 | Fukasawa et al. ..... | 270/45 |
| 8,226,077 | B2 * | 7/2012 | Iguchi et al. ..... | 270/37 |
| 8,336,869 | B2 * | 12/2012 | Fukatsu et al. ..... | 270/45 |

FOREIGN PATENT DOCUMENTS

| | | | |
|---|---|---|---|
| JP | 2008156113 | A | 7/2008 |
| JP | 2013180881 | A | 9/2013 |
| JP | 2013220916 | A | 10/2013 |

* cited by examiner

| NUMBER OF SHEET(S) TO BE FOLDED | STEP-OUT PREVENTION CONTROL |
|---|---|
| ONE SHEET | TO BE CARRIED OUT |
| MORE THAN ONE SHEET | NOT TO BE CARRIED OUT |

| PAPER WEIGHT | STEP-OUT PREVENTION CONTROL |
|---|---|
| LESS THAN 62 g/m$^2$ | TO BE CARRIED OUT |
| NOT LESS THAN 62 g/m$^2$ | NOT TO BE CARRIED OUT |

SHEET-PROCESSING APPARATUS THAT FOLDS A SHEET, AND IMAGE-FORMING SYSTEM USING THE SAME

CROSS REFERENCE TO RELATED APPLICATION

The present invention contains subject matter related to Japanese Patent Application JP 2014-108343 filed in the Japanese Patent Office on May 26, 2014, the entire contents of which being incorporated herein by reference.

BACKGROUND OF THE INVENTION

Field of the Invention

The present invention relates to a sheet-processing apparatus that folds a sheet(s) and an image-forming system that uses such a sheet-processing apparatus.

Description of Related Art

A post-processing apparatus has been widely utilized. The post-processing apparatus has performed a predetermined post-processing on a sheet(s) on which an image-forming apparatus has already formed an image. The post-processing apparatus is connected with the image-forming apparatus in line at a downstream side along a sheet-conveying direction of the image-forming apparatus. The post-processing apparatus performs, for example, a center-fold finishing on a sheet(s). The post-processing apparatus performing the center-fold finishing contains a pair of folding rollers and a folding blade that thrusts a sheet(s) to a position between the pair of folding rollers to perform the center-fold finishing on the sheet(s) on a crease thereof.

For example, Japanese Patent Application Publication No. 2008-156113 has disclosed a post-processing apparatus in which a driving speed of a folding-rollers-driving motor varies during various kinds of processing steps such as a step until the blade attaches a bundle of sheets, a step while the bundle of folded sheets is conveyed to an outlet and a step of ejecting the bundle of folded sheets. Further, Japanese Patent Application Publication No. 2007-76832 has disclosed a sheet-processing apparatus including CPU which selects processing speeds of a thrust blade and folding rollers based on obtained sheet information and sheet information stored on ROM and controls operations of the thrust blade and the folding rollers based on the selected processing speeds thereof.

SUMMARY OF THE INVENTION

The post-processing apparatus or the sheet-processing apparatus disclosed in the above documents generally has often adapted a brush motor or a brushless motor as driving source of the folding rollers. In order to improve a folding accuracy, a stepper motor may be adapted because the stepper motor can locate a sheet on an accurate position.

However, such a stepper motor adapted as the driving source of the folding rollers in a sheet-processing apparatus may be stepped out of phase when there is any large friction force between the folding roller and the sheet and/or between the sheet and the folding blade. In the other words, when the center-fold finishing of sheet(s) is completed and the folding blade is pulled out of the position between the folding rollers, the folding rollers rotate to their rotation directions which are respectively opposite to a pulling direction of the folding blade. As a result thereof, any large friction force occurs between the folding roller and the sheet and/or between the sheet and the folding blade, so that the stepper motor may be stepped out of phase.

The present invention addresses the above-described issue by modifying the sheet-processing apparatus and the image-forming system using the same. The present invention has an object to provide the sheet-processing apparatus and the image-forming system using the same, which prevent a driving unit, which drives the folding rollers, of the sheet-processing apparatus from being stepped out of phase.

To achieve the above mentioned object, a sheet-processing apparatus reflecting one aspect of the present invention contains a pair of rollers that folds a sheet, a thrusting member that thrusts the sheet to a position between the pair of folding rollers, a driving member that drives the pair of folding rollers to rotate, and a control unit that controls the driving member, wherein after the thrusting member thrusts the sheet to the position between the pair of folding rollers, the control unit controls the driving member to stop or decelerate the rotation of the pair of folding rollers, in timing at which the thrusting member is pulled out of the position between the pair of folding rollers.

According to embodiments of the present invention, it is desired to provide the sheet-processing apparatus wherein the driving member includes a stepper motor.

It is further desired to provide the sheet-processing apparatus wherein the control unit determines whether or not the driving member stops or decelerates the rotation of the pair of folding rollers based on an image-forming condition when forming an image on the sheet.

It is additionally desired to provide the sheet-processing apparatus wherein the image-forming condition includes any of a number of sheets to be folded and paper weight of the sheet.

It is still further desired to provide the sheet-processing apparatus wherein the control unit controls the driving member to stop the rotation of the pair of folding rollers by exciting the driving member when the thrusting member is pulled out of the position between the pair of folding rollers.

Other objects and attainments of the present invention will be become apparent to those skilled in the art upon a reading of the following detailed description when taken in conjunction with the drawing.

DESCRIPTION OF THE PREFERRED EMBODIMENTS

The following will describe embodiments of a sheet-processing apparatus and an image forming system using the same according to the present invention with reference to the drawings. Such description does not limit the technical scope, meaning of terms and the like in Claims. Sizes and/or ratios of elements shown in drawings are exaggeratedly shown for convenience of explanation so that they may be different from the actual ones.

First Embodiment of Present Invention (Configuration Example of Image-Forming System)

Figure 1:
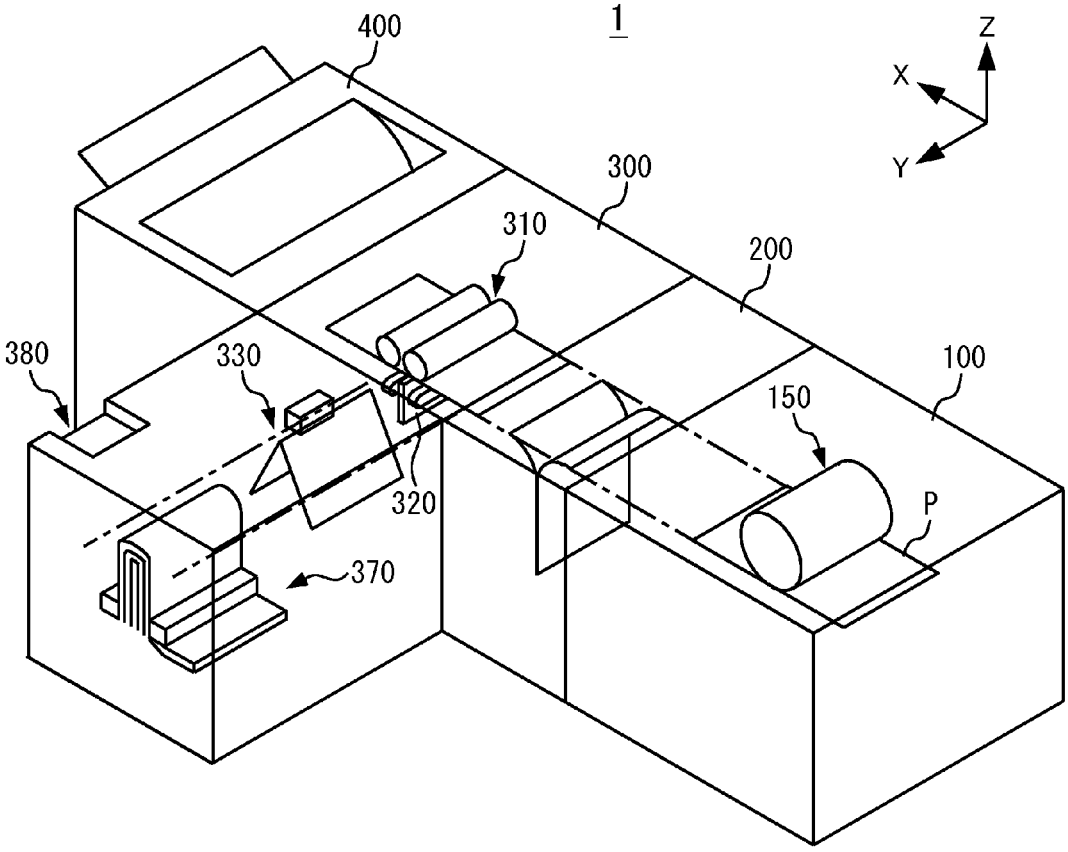
FIG. 1 is a diagram showing a configuration example of an image-forming system according to a first embodiment of the invention.

An image-forming system 1, as shown in FIG. 1, according to the first embodiment of this invention contains a saddle-stitching apparatus 300 according to the embodiment of this invention, and an image-forming apparatus 100 that forms an image on a sheet and discharges it. The image-forming system 1 also contains an intermediate transportation apparatus 200 and a side-stitching apparatus 400. In the following, Z-direction shown in the drawings will indicate a vertical direction. X-direction will indicate a direction in which the image-forming apparatus 100, the intermediate transportation apparatus 200, the saddle-stitching apparatus 300 and the side-stitching apparatus 400 are connected with each other. Y-direction will indicate a direction that is perpendicular to the X-direction and the Z-direction.

The image-forming apparatus 100 contains a feeder, an image-forming unit 150, a fixing unit, a discharging unit and like. The feeder brings a sheet P out of a paper tray to transport it to the image-forming unit 150. The image-forming unit 150 contains charging units, exposure units, developing units, photosensitive drums, transfer units and the like. Each of the charging unit uniformly charges static charges around a surface of each of the photosensitive drums so that the surface has negative polarity. Each of the exposure units forms electrostatic a latent image on each of the photosensitive drums based on image data on which a predetermined image processing is performed. Each of the developing units reveres and develops the electrostatic latent image to form a toner image on each of the photosensitive drums. The transfer units transfer the toner images on the photosensitive drums to a surface of the sheet transported from the feeder.

The fixing unit heats and pressurizes the toner images transferred by the transfer units and fixes the transferred toner images on the sheet P. The discharging unit discharges the fixed sheet. The discharged sheet P is conveyed to the intermediate transportation apparatus 200 at downstream side along the X-direction (sheet-conveying direction). The following will describe the image-forming apparatus 100 that can form a monochrome image, in the embodiments of the invention but this invention is not limited thereto. The invention is applicable to an image-forming apparatus called as "tandem type image-forming apparatus" that can form a color image.

The intermediate transportation apparatus 200 contains a stacker, an aligning unit, a creaser and a slitter. The stacker transports sheets conveyed from the image-forming apparatus 100 and stops the transportation of the sheets P to stand while they are held with their surfaces being almost faced to the Z-direction. The aligning unit aligns positions of the sheets stood in the stacker along the width direction thereof. The creaser forms a fold on the aligned sheets by folding them. The slitter trims any margin in each of the sheets P while transporting the sheets P on each of which the fold has been formed. The intermediate transportation apparatus 200 conveys the trimmed sheets to the saddle-stitching apparatus 300 at the downstream side thereof along the X-direction. It is to be noted that the intermediate transportation apparatus 200 may convey the sheets P received from the image-forming apparatus 100 to the saddle-stitching apparatus 300 without performing all or any of various kinds of processing such as aligning processing and slitting processing on the sheets P.

The saddle-stitching apparatus 300 performs as a sheet-processing apparatus a center-fold processing for center-folding the sheet (by two), a sheet-stapling processing to staple the sheets to form a booklet, an edge-cutting processing to cut the edge of the booklet and the like.

For example, the saddle-stitching apparatus 300 contains a center-folding unit 310, a transporting mechanism 320, a sheet-stapling unit 330, a cutting unit 370 and a discharging unit 380. The center-folding unit 310 performs center-fold finishing on each of the sheets conveyed from the intermediate transportation apparatus 200 along the fold (Y-direction). This center-fold finishing is performed on the sheets one by one or every plural sheets. The transporting mechanism 320 transports each of the sheets center-fold by the center-folding unit 310 along the Y-direction (to the front side of FIG. 1). The sheet-stapling unit 330 lays the sheets P transported by the transporting mechanism 320 to form a bundle of sheets and then, staples the bundle of sheets thus formed. The cutting portion 370 cuts the edge of the bundle of sheets stapled by the sheet-stapling unit 330 and forms a saddle-stitched booklet. The discharging unit 380 discharges the saddle-stitched booklet, the edge of which is cut by the cutting portion 370, onto a tray of outside.

It is to be noted that the saddle-stitching apparatus 300 may convey the sheets P conveyed from the intermediate transportation apparatus 200 to the side-stitching apparatus 400 without performing all or any of various kinds of processing such as center-fold finishing, saddle-stitching processing and end-cutting processing on the sheets P. The saddle-stitching apparatus 300 may include a processing unit that performs a square fold processing on the saddle-stitched booklet to shape a backbone thereof.

The side-stitching apparatus 400 contains a stapling unit, a page-edge-cutting unit and a discharging unit. The stapling unit staples the plural sheets P conveyed from the saddle-stitching apparatus 300. The page-edge-cutting unit cuts a part of the edge of each of the plural sheets P stapled by the stapling unit to align the cut edges of the plural sheets P. The discharging unit discharges the sheet(s), the booklet or the like, processed by each apparatus connected to the side-stitching apparatus 400, to a tray. It is to be noted that the side-stitching apparatus 400 may discharges the sheet(s) P conveyed by the saddle-stitching apparatus 300 from the discharging unit without performing all or any of various kinds of processing such as stapling processing on the sheets P.

(Configuration Example of Center-Folding Unit)

Figure 2:
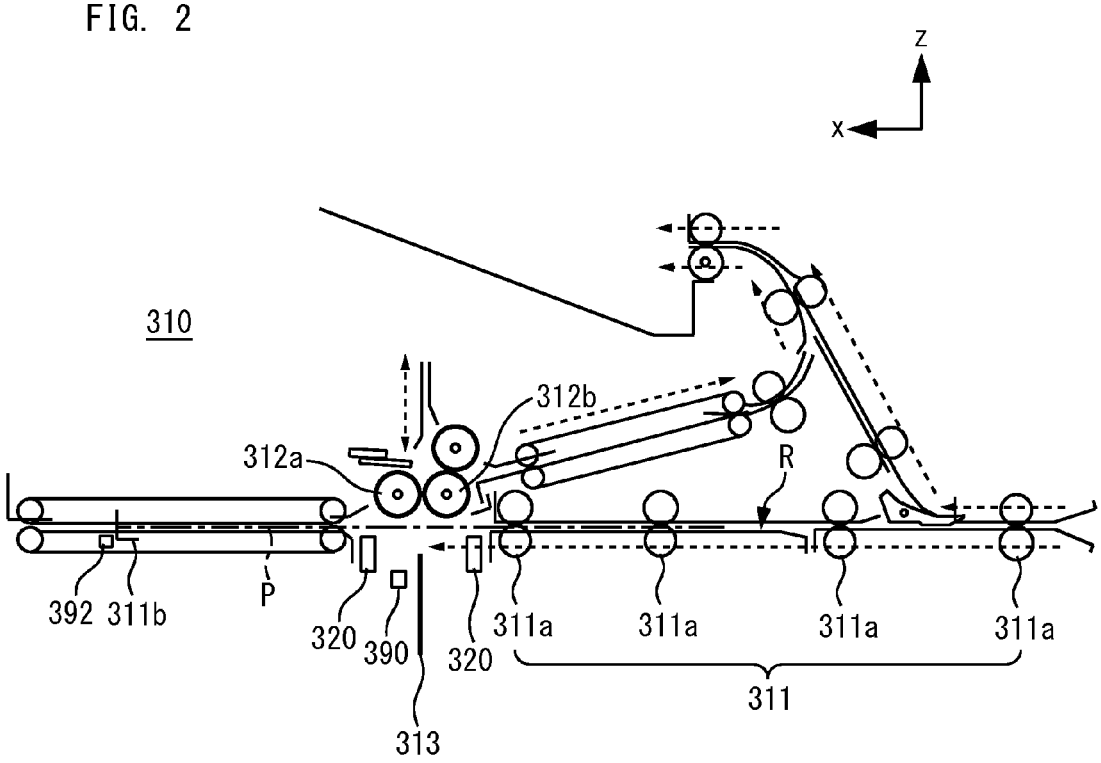
FIG. 2 is a diagram showing a configuration example of a center-folding unit.

The following will describe the center-folding unit 310 more in detail. As shown in FIG. 2, the center-folding unit 310 contains a transporting portion 311, a pair of folding rollers 312*a*, 312*b*, a folding blade 313 as a thrusting member, a folding-rollers-driving member 314, a folding-blade detection portion 390 and a sheet-detection portion 392.

The transporting portion 311 includes plural transporting rollers 311*a* and a stopper 311*b*. The plural transporting rollers 311*a* are arranged with them being away from each other at a regular interval on a sheet-transporting path R. The transporting rollers 311*a* transport the sheet P conveyed from the image-forming apparatus 100 so that a fold of the sheet P is opposed to the folding blade 313. The stopper 311*b* is arranged at a downstream side along the X-direction on the sheet-transporting path R. The stopper 311*b* stops the sheet P at a folding position thereof by blocking the movement of the sheet transported by the transporting rollers 311*a*. It is to be noted that the stopper 311*b* is configured to be movable along the sheet-transporting path R so that a position of the stopper 311*b* may be changed according to a size of the sheet.

Each of the folding rollers 312*a*, 312*b* is configured to be rotatable. A nip position is also configured between the folding rollers 312*a*, 312*b* so that their circumference surfaces may be attached to each other. The folding rollers 312*a*, 312*b* perform the center-fold finishing on the sheet P at the fold position by transporting the sheet P with the sheet P being nipped at the nip position. In this embodiment, when the folding blade 313 is pulled out of the nip position between the folding rollers 312*a*, 312*b* during the center-fold finishing on the sheet P, a control to stop or decelerate the rotation of each of the folding rollers 312*a*, 312*b* is carried out. This prevents the folding-rollers-driving member 314 from being stepped out of phase (hereinafter, referred to as, "step-out prevention control").

The folding blade 313 is made of plate-like member. The folding blade 313 is arranged so that its plane is set along Y-Z planes. The folding blade 313 is also arranged at a position (hereinafter, referred to as, "retrieved position") below the folding rollers 312*a*, 312*b* and the transporting sheet P. The folding blade 313 is configured so that the retrieved position is a home position. The folding blade 313 reciprocally moves up and down between the retrieved position and a position (hereinafter, referred to as, "folding completion position" and see FIG. 5D) where a forward end of the folding blade 313 thrusts the sheet P out of the nip position between the folding rollers 312*a*, 312*b*. This allows the sheet P to be center-folded with the sheet P being so-called mountain folded where the fold is configured to be upper side and both ends are configured to be lower sides. Such center-fold finishing may be performed one by one or every plural sheets.

The folding-blade detection portion 390 is arranged near, for example, the folding blade 313 and detects operations of the folding blade 313 when it is thrust and retrieved. The sheet-detection portion 392 is arranged near, for example, the stopper 311*b* and detects whether or not the sheet P is transported at the folding position based on whether or not an end of the sheet P contacts the stopper 311*b*.

(Block Configuration of Saddle-Stitching Apparatus)

Figure 3:
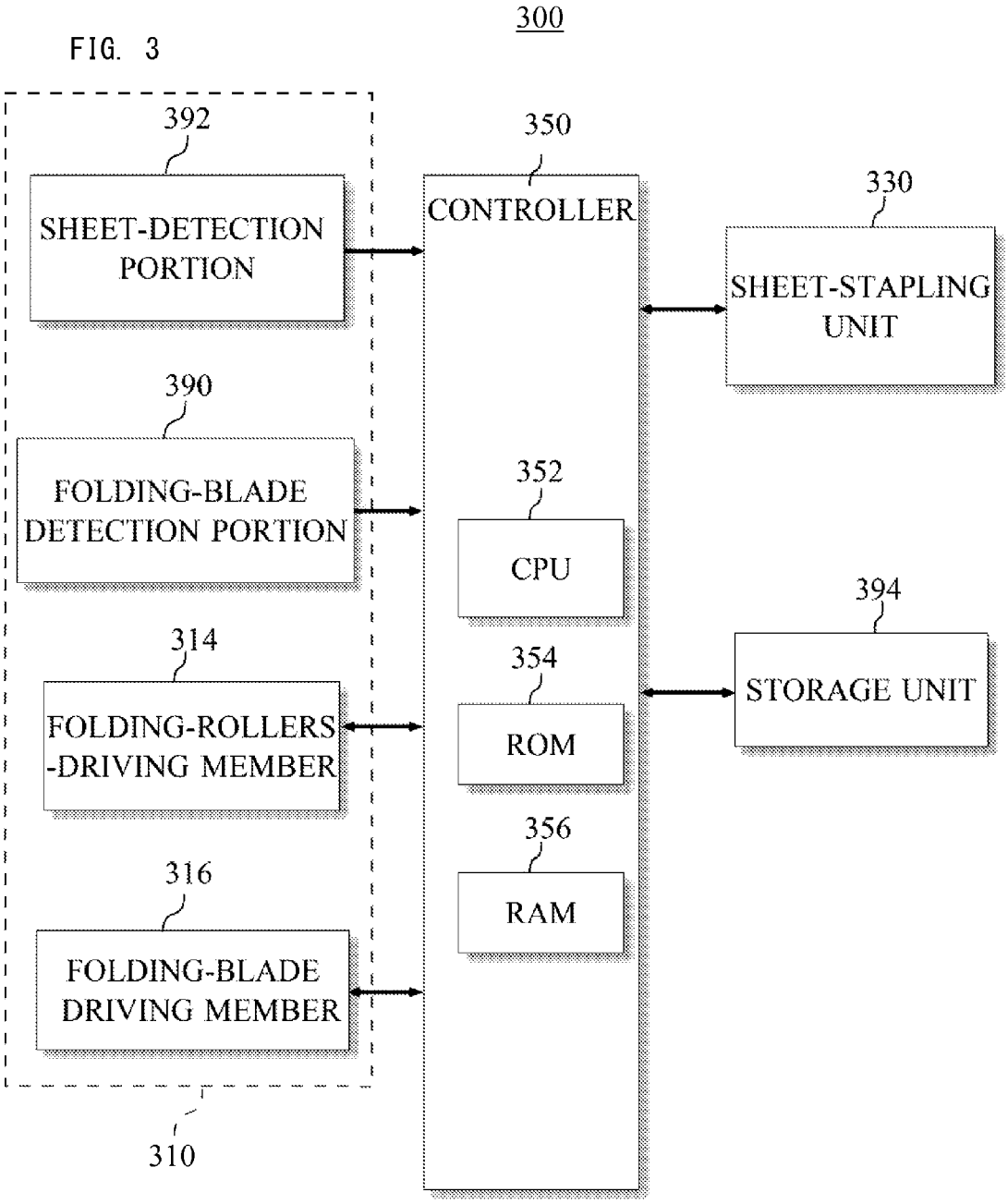
FIG. 3 is a block diagram showing a configuration example of a saddle-stitching apparatus as a sheet-processing apparatus according to the first embodiment of the invention.

The following will describe function and configuration of the saddle-stitching apparatus 300 as sheet-processing apparatus more in detail with reference to FIG. 3. As shown in FIG. 3, the saddle-stitching apparatus 300 contains a controller 350, the center-folding unit 310, the sheet-stapling unit 330 and a storage unit 394.

The controller 350 includes a central processing unit (CPU) 352, a read only memory (ROM) 354 and a random access memory (RAM) 356. The CPU 352 controls operation of whole of the saddle-stitching apparatus 300 together with a main controller, not shown, of the image-forming apparatus 100. The CPU 352 also performs any software (programs) read out of the ROM 354 to realize various kinds of functions such as the center-fold finishing and the like.

The controller 350 performs the step-out prevention control to prevent the folding-rollers-driving member 314, which is composed of a stepper motor, from being step out of phase during the center-fold finishing. In the step-out prevention control, after the center-fold finishing is completed, the controller 350 controls the folding-rollers-driving member 314 to stop or decelerate the rotation of the folding rollers 312*a*, 312*b* in timing at which the folding blade 313 is pulled out of the nip position between the folding rollers 312*a*, 312*b*.

The center-folding unit 310 includes the folding-rollers-driving member 314 and a folding-blade-driving member 316. The folding-rollers-driving member 314 is composed of, for example, a stepper motor which can exactly locate the sheet P. The folding-rollers-driving member 314 rotates at forward and reverse rotation directions based on a control signal (pulse signal) received from the controller 350. The folding-blade-driving member 316 is composed of, for example, a brushless motor, a stepper motor or the like. The folding-blade-driving member 316 rotates at forward and reverse rotation directions based on a control signal (pulse signal) received from the controller 350.

The sheet-detection portion 392 is composed of, for example, a transmission type optical sensor, a reflection type optical sensor or the like. The sheet-detection portion 392 detects the end of the sheet P transported on the sheet-transporting path R of the center-folding unit 310 and supplies a detection signal to the controller 350. The folding-blade detection portion 390 is also composed of, for example, a transmission type optical sensor, a reflection type optical sensor or the like. The folding-blade detection portion 390 detects the vertical movement of the folding blade 313 and supplies a detection signal to the controller 350.

The storage unit 394 includes a nonvolatile semiconductor memory, hard disk drive (HDD) and the like. The storage unit 394 stores any image-forming conditions such as numbers of the sheets to be folded during the center-fold finishing, paper weight and the like, timing information (pulse information) for determining the timing of stopping or decelerating the rotation of the folding rollers 312*a*, 312*b* when performing the step-out prevention control. It is to be noted that ROM and/or RAM may store these pieces of information.

(Operation Examples of Saddle-Stitching Apparatus and Image-Forming System According to the First Embodiment)

The following will describe operations to perform the center-fold finishing on the sheets P in the saddle-stitching apparatus 300 and the image-forming system 1 according to the first embodiment of the invention with reference to the drawings.

Figure 4:
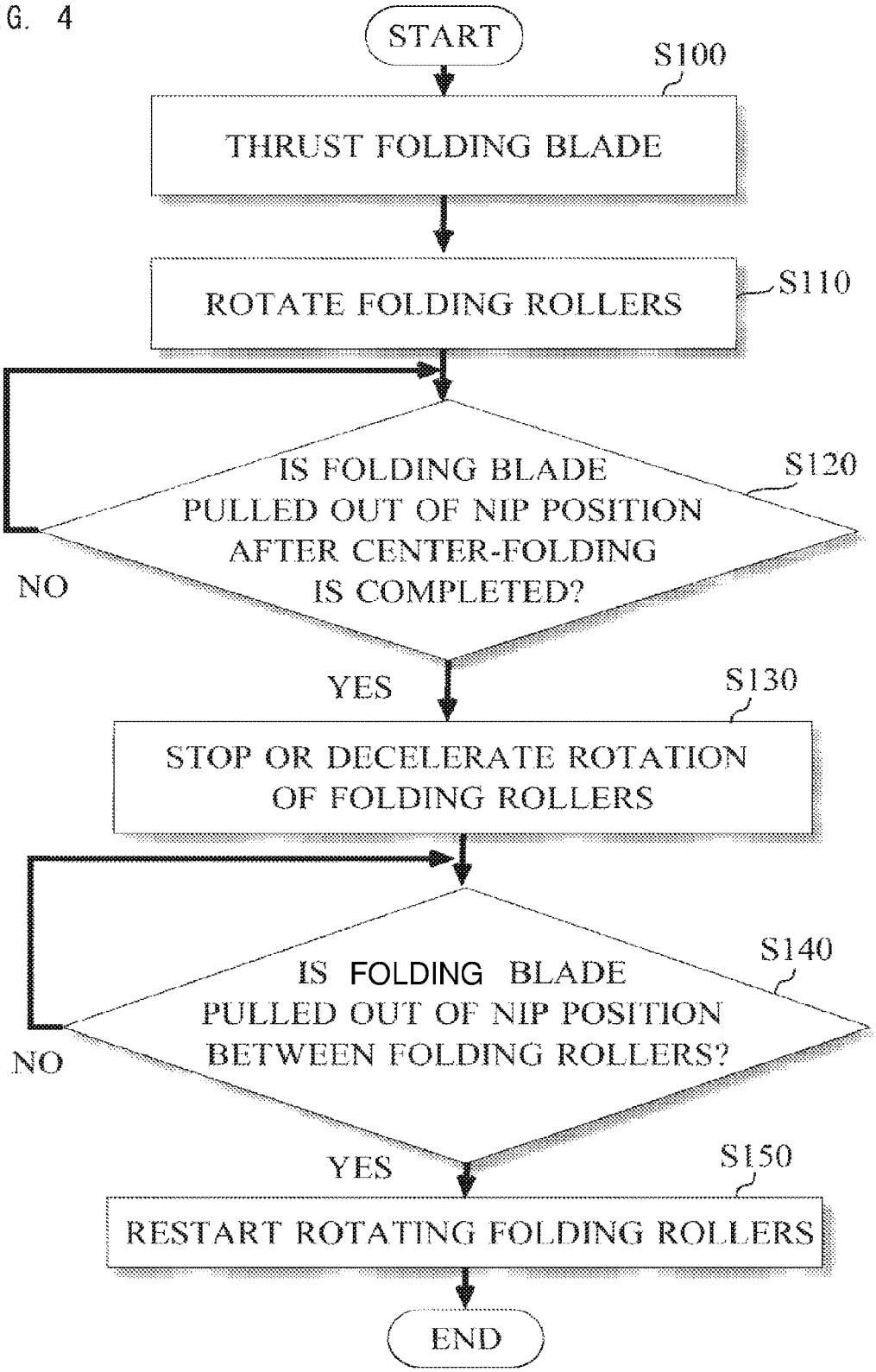
FIG. 4 is a flowchart showing an operation example of the saddle-stitching apparatus when performing the center-fold finishing on the sheet(s)

FIG. 4 shows an operation example of the saddle-stitching apparatus 300 when performing the center-fold finishing on the sheet(s) P. FIGS. 5A through 5F show relationships among the folding rollers 312*a*, 312*b*, the folding blade 313 and the sheet P when performing the center-fold finishing on the sheet P. It is to be noted that although the folding rollers 312*a*, 312*b* will be shown in FIGS. 5A through 5F so that they are away from each other, they are actually contacted to each other.

Figure 5A:
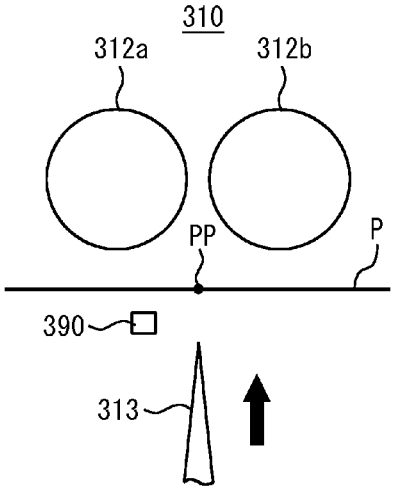
FIGS. 5A through 5F are diagrams each showing relationships among folding rollers, folding blade and the sheet when performing the center-fold finishing on the sheet(s)

The image-forming apparatus 100 forms a desired image on the sheet P. The sheet P is conveyed to the center-folding unit 310 of the saddle-stitching apparatus 300 via the intermediate transportation apparatus 200. Specifically, as shown in FIG. 5A, the sheet P is transported to a position between each of the folding rollers 312*a*, 312*b* and the folding blade 313 with the fold PP of the sheet P being opposed to the folding blade 313.

Figure 5B:
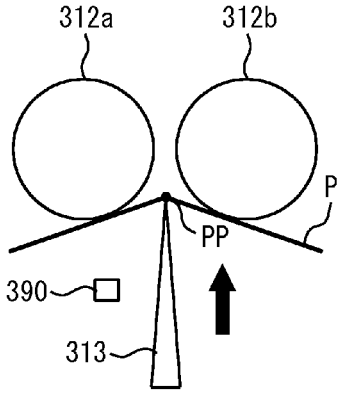

As shown in FIG. 4, when transporting the sheet P to the center-folding unit 310, at a step S100, the controller 350 controls the folding-blade-driving member 316 to start thrusting operation of the folding blade 313. For example, the controller 350 determines whether or not the folding-blade-driving member 316 starts thrusting operation of the folding blade 313 based on a detection result of the sheet P by the sheet-detection portion 392. The folding blade 313 moves (approaches) from the retrieved position to the nip position between the folding rollers 312*a*, 312*b*, as shown in FIG. 5B, by the driving of the folding-blade-driving member 316. Accordingly, a forward end of the folding blade 313 comes into contact with the fold PP of the sheet P, so that the sheet P is folded along the fold PP.

Figure 5C:
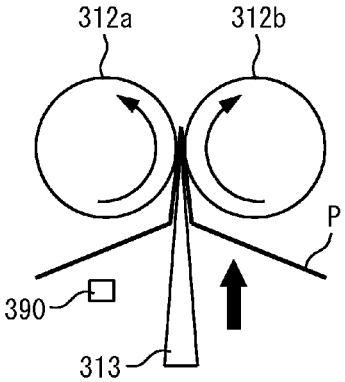
Figure 5D:
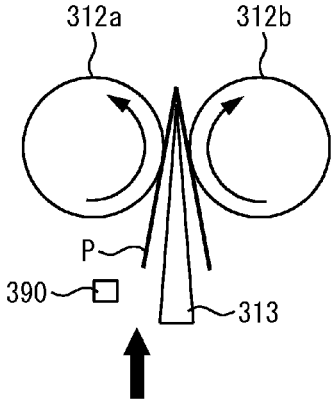

At a step S110, the controller 350 controls the folding-rollers-driving member 314 to start the rotations of the folding rollers 312*a*, 312*b* in timing at which the folding blade 313 pushes the sheet P which is attached to the nip position between the folding rollers 312*a*, 312*b*. As shown in FIGS. 5C and 5D, the center-folded sheet P is inserted between the folding rollers 312*a*, 312*b* together with the folding blade 313, by the rotations of the folding rollers 312*a*, 312*b* and the thrusting operation of the folding blade 313. The folding blade 313 then moves upward together with the center-folded sheet P up to the folding-completion position.

At a step S120, the controller 350 determines whether or not it is the timing at which the folding blade 313 is pulled out of the nip position between the folding rollers 312*a*, 312*b* after the center-fold finishing of the sheet P is completed. For example, the controller 350 may determine the timing at which the folding blade 313 is pulled out of the nip position based on information of pulse numbers, time and the like of the folding-blade-driving member 316 from a point of turn-on time of the folding-blade detection portion 390 to a point of time when the folding blade 313 reaches the center-folding complete position (or a point of time when the folding blade 313 returns from the center-folding complete position). The storage unit 394 stores previously set pulse numbers, time and the like of the folding-blade-driving member 316. Further, the timing at which the folding blade 313 is pulled out may be determined using a sensor or other known mean.

When the controller 350 determines that it is the timing at which the folding blade 313 is pulled out of the nip position between the folding rollers 312*a*, 312*b*, the controller 350 goes to a step S130. On the other hand, when the controller 350 determines that it is not the timing at which the folding blade 313 is pulled out of the nip position between the folding rollers 312*a*, 312*b*, the controller 350 continuously determines whether or not it is the timing at which the folding blade 313 is pulled out of the nip position between the folding rollers 312*a*, 312*b*.

Figure 5E:
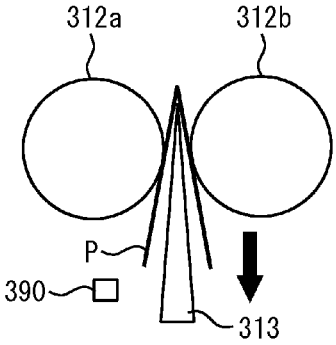

When the controller 350 determines that it is the timing at which the folding blade 313 is pulled out of the nip position between the folding rollers 312*a*, 312*b*, the controller 350 performs the step-out prevention control and controls the folding-rollers-driving member 314 to stop the driving thereof. This allows the rotations of the folding rollers 312*a*, 312*b* to stop. The folding blade 313 is then retrieved from the folding completion position to the retrieved position, as shown in FIG. 5E.

At a step S140, the controller 350 determines whether or not the folding blade 313 is pulled out of the nip position between the folding rollers 312*a*, 312*b*. For example, the controller 350 may determine whether or not the folding blade 313 is pulled out of the nip position based on information of pulse numbers, time and the like of the folding-blade-driving member 316 from a point of time when the folding blade 313 returns from the center folding completion position to a point of time when the folding blade 313 is completely pulled out of the nip position between the folding rollers 312*a*, 312*b*. The storage unit 394 stores previously set pulse numbers, time and the like of the folding-blade-driving member 316. Further, it may be determined using a sensor or other known mean whether or not the folding blade 313 is pulled out of the nip position.

When the controller 350 determines that the folding blade 313 is pulled out of the nip position between the folding rollers 312*a*, 312*b*, the controller 350 goes to a step S150. On the other hand, when the controller 350 determines that the folding blade 313 is not pulled out of the nip position between the folding rollers 312*a*, 312*b*, the controller 350 continuously determines whether or not the folding blade 313 is pulled out of the nip position between the folding rollers 312*a*, 312*b*.

Figure 5F:
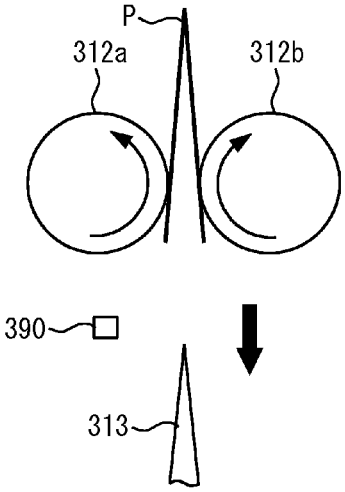

At a step S150, the controller 350 controls the folding-rollers-driving member 314, which have been stopped because of the step-out prevention control, to restart the rotations of the folding rollers 312*a*, 312*b*, as shown in FIG. 5F. The controller 350 then controls the folding-rollers-driving member 314 to reversely rotate, so that the center-folded sheet P is ejected from the nip position between the folding rollers 312*a*, 312*b* and transported to the sheet-stapling unit 330.

Although the step-out prevention control where the rotations of the folding rollers 312*a*, 312*b* stop has been described on the above flowchart, this invention is not limited thereto: The rotations of the folding rollers 312*a*, 312*b* may be controlled so as to be decelerated.

(Relationship Between Rotation Speed of Folding Rollers and Time During Center-Fold Finishing)

Figures 6, 7A, 7B:
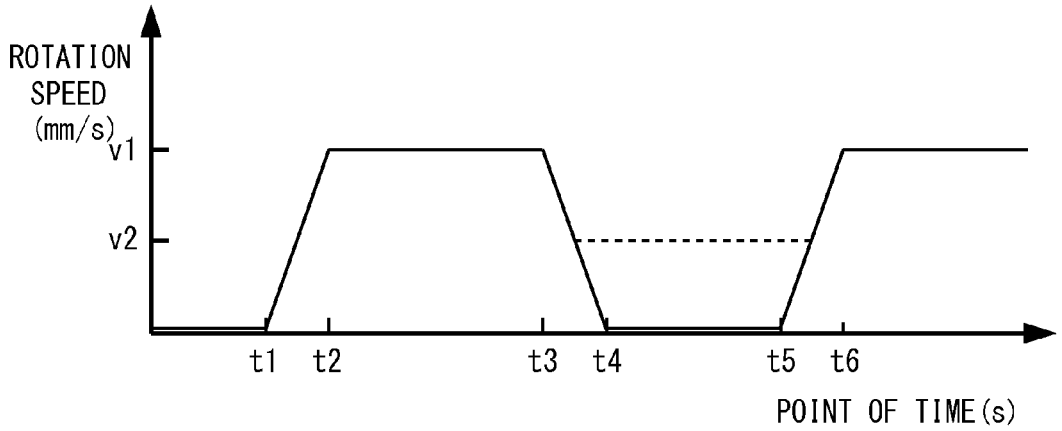
FIG. 6 is a graph showing a relationship between a rotation speed of the folding rollers and time when performing the center-fold finishing on the sheet(s)
FIGS. 7A and 7B are tables each describing a condition when performing a step-out prevention control according to a second embodiment of the invention.

The following will specifically describe a relationship between rotation speed of the folding rollers 312*a*, 312*b* and time during the above-mentioned center-fold finishing of the sheet P. FIG. 6 shows the relationship between the rotation speed of the folding rollers 312*a*, 312*b* and the time during the above-mentioned center-fold finishing of the sheet P. In FIG. 6, a vertical axis indicates the rotation speed of folding rollers 312*a*, 312*b* and a horizontal axis indicates the time.

When the center-fold finishing of the sheet P starts, the folding blade 313 starts thrusting operation in which the folding blade 313 moves toward the folding rollers 312*a*, 312*b*. When the sheet P reaches the nip position between the folding rollers 312*a*, 312*b* by the thrusting operation of the folding blade 313, at a point of time t1, the controller 350 controls the folding-rollers-driving member 314 to rotate the folding rollers 312*a*, 312*b*. This enables the rotation speed of the folding rollers 312*a*, 312*b* to be accelerated. At a point of time t2, the rotation speed of the folding rollers 312*a*, 312*b* reaches rotation speed v1.

When the center-fold finishing of the sheet P is completed, a retrieving operation of the folding blade 313 in which the folding blade 313 is pulled out of the nip position between the folding rollers 312*a*, 312*b* starts. The controller 350 controls the folding-rollers-driving member 314 to stop driving the folding rollers 312*a*, 312*b* at a point of time t3 when the retrieving operation starts. This enables the rotation speed of the folding rollers 312*a*, 312*b* to be decelerated, so that at a point of time t4, the rotation of the folding rollers 312*a*, 312*b* stops (Step-out Prevention Control).

When the folding blade 313 is completely pulled out of the nip position between the folding rollers 312*a*, 312*b*, at a point of time t5, the controller 350 restarts driving the folding-rollers-driving member 314 to rotate the folding rollers 312*a*, 312*b*. This enables the rotation speed of the folding rollers 312*a*, 312*b* to be accelerated. At a point of time t6, the rotation speed of the folding rollers 312*a*, 312*b* returns to the rotation speed v1.

Although in the above-mentioned embodiment, at the point of time t3 when the folding blade 313 has been pulled out of the nip position between the folding rollers 312*a*, 312*b*, the controller 350 has controlled the folding-rollers-driving member 314 to stop the rotation of the folding rollers 312*a*, 312*b*, this invention is not limited thereto: The controller 350 can control the folding-rollers-driving member 314 to decelerate the rotation speed of the folding rollers 312*a*, 312*b*. For example, as shown by the dotted lines in FIG. 6, the controller 350 controls the folding-rollers-driving member 314 to decelerate the rotation speed of the folding rollers 312*a*, 312*b*, so that the rotation speed v1 of the folding rollers 312*a*, 312*b* may retard to reach the rotation speed v2 thereof.

As described above, according to the first embodiment of the invention, since the controller 350 controls the folding-rollers-driving member 314 to stop or decelerate the rotation of the folding rollers 312*a*, 312*b* in timing at which the folding blade 313 is pulled out of the nip position between the folding rollers 312*a*, 312*b*, it is possible to decrease friction force generated between the folding roller and the sheet and/or between the sheet and the folding blade. This prevents the folding-rollers-driving member 314 from being stepped out of phase, so that it is possible to prevent productivity of the image-forming system 1 because of the stop of saddle-stitching apparatus 300 by the step-out-of-phase thereof from lowering.

Further, according to the first embodiment, since it is possible to prevent the folding-rollers-driving member 314 from being stepped out of phase without increasing in size of the folding-rollers-driving member 314, it is possible to avoid the increase in size of the saddle-stitching apparatus 300. Additionally, since the stepper motor is used as the folding-rollers-driving member 314, it is possible to locate the sheet P (or to set an amount of the transport of the sheet P) accurately with high precision.

Second Embodiment of Present Invention

The second embodiment is different from the above-mentioned first embodiment in that the controller 350 determines whether or not the step-out prevention control to stop or decelerate the rotation of the folding rollers 312*a*, 312*b* is carried out on the basis of an image-forming condition when forming an image on the sheet P such as a number of the sheet(s) P to be folded and paper weight of the sheet P. Other configuration and operations in the image-forming system 1 is similar to those of the above-mentioned first embodiment so that like signs are attached like elements, a detailed explanation of which will be omitted.

(Conditions for Carrying Out Step-Out Prevention Control)

FIG. 7A shows conditions of the number of the sheet(s) P to be folded when performing the step-out prevention control. In the second embodiment, as shown in FIG. 7A, when the sheet P to be folded is one sheet, the step-out prevention control is carried out but when the sheets P to be folded are plural sheets, the step-out prevention control is not carried out.

This is because the fewer number of the sheets P are folded, the larger friction force occurs between the folding roller and the sheet and/or between the sheet and the folding blade, so that the folding-blade-driving member 316 composed of a stepper motor is subject to the generation of the step-out of phase. Particularly, this is because when the sheet P to be folded is one sheet, there is a tendency to generate larger friction force between each of the folding rollers 312*a*, 312*b* and the sheet. This is also because if the step-out prevention control is carried out when the sheets P to be folded are plural sheets (more than one sheet), smaller friction force occurs between each of the folding rollers 312*a*, 312*b* and the bundle of sheets P so that sheet(s) P inside the bundle of sheets may be pulled at the same time when pulling the folding blade 313 and be left out.

FIG. 7B shows paper weight conditions of the sheet P to be folded when performing the step-out prevention control. In the second embodiment, as shown in FIG. 7B, when the paper weight of the sheet P to be folded is less than 62 g/m$^2$, the step-out prevention control is carried out but when the paper weight of the sheet P to be folded is not less than 62 g/m$^2$, the step-out prevention control is not carried out.

This is because the smaller paper weight the sheets P has, the larger friction force occurs between each of the folding rollers 312*a*, 312*b* and the sheet P and/or between the sheet P and the folding blade 313, so that the folding-blade-driving member 316 composed of a stepper motor is subject to the generation of the step-out of phase. Particularly, this is because when the sheet P has the paper weight of less than 62 g/m$^2$, there is a tendency to generate larger friction force between each of the folding rollers 312*a*, 312*b* and the sheet P.

A user may manipulate, for example, a screen of a manipulation/display unit, a screen of a computer connected through a network or the like to set information about the number of sheets to be folded and/or the paper weight of sheet. The storage unit 394 stores pieces of the information about the number of sheets to be folded and/or the paper weight of sheet, received by the manipulation/display unit or the like, respectively, as the image-forming conditions (job information). The controller 350 determines whether or not the step-out prevention control is carried out on the basis of the information about the number of sheets to be folded and/or the paper weight of sheet, received through the manipulation/display unit or the like.

Moreover, in the second embodiment, although the step-out prevention control has been carried out when the sheet P to be folded is one sheet, the invention is not limited thereto: The conditions of the number of sheets to be folded may be suitably set to be optimal values due to properties of the folding rollers 312*a*, 312*b*, folding blade 313, the folding-blade-driving member 316 and the like. Similarly, in the second embodiment, although the step-out prevention control has been carried out when the sheet P has paper weight of less than 62 g/m$^2$, the invention is not limited thereto: The conditions of the paper weight may be suitably set to be optimal values due to properties of the folding rollers 312*a*, 312*b* and the like. Further, the controller 350 may determine whether or not the step-out prevention control is carried out on the basis of a combination of the number of sheets to be folded and the paper weight.

(Operation Examples of Saddle-Stitching Apparatus and Image-Forming System According to Second Embodiment)

The following will describe operations to perform the center-fold finishing on the sheet P in the saddle-stitching apparatus 300 and the image-forming system 1 according to the second embodiment of the invention with reference to the drawings.

Figure 8:
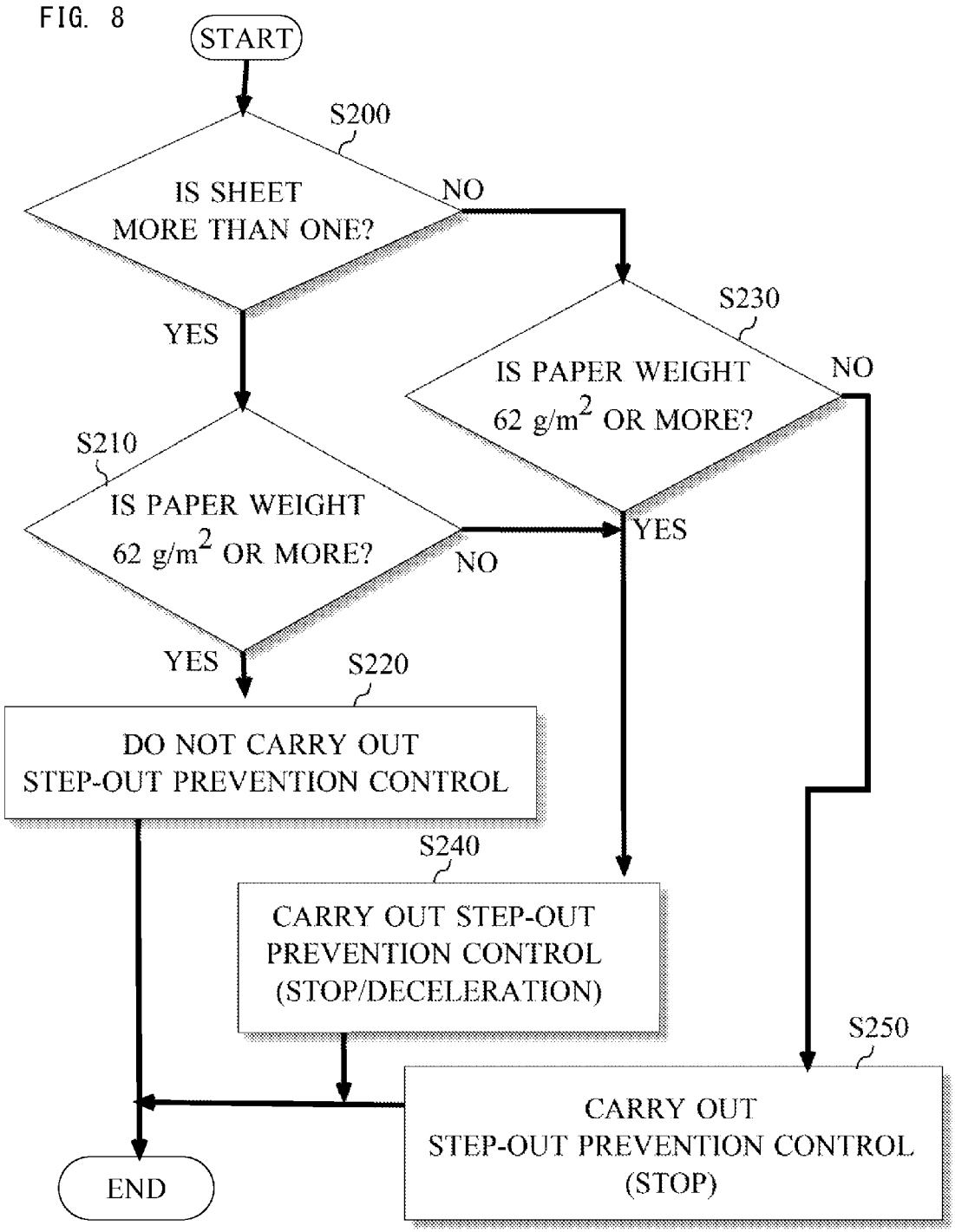
FIG. 8 is a flowchart showing an operation example of the saddle-stitching apparatus when performing the center-fold finishing on the sheet(s).

FIG. 8 shows an operation example of the saddle-stitching apparatus 300 when performing the center-fold finishing on the sheet. The following will describe a case where the controller 350 determines whether or not the step-out prevention control is carried out on the basis of a combination of the number of sheets to be folded and the paper weight. It is to be noted that this processing is a variation of the step S130 of the flowchart shown in FIG. 4 of the first embodiment and other steps are similar to the steps S100 through S120, S140 and S150 of the first embodiment, the detailed explanation of which will be omitted.

As shown in FIG. 8, at a step S200, the controller 350 determines whether or not the sheet(s) P to be folded during the center-fold finishing is (are) more than one sheet. The controller 350 determines that the sheets P to be folded during the center-fold finishing are more than one sheet, the controller 350 goes to a step S210. The controller 350 determines that the sheet P to be folded during the center-fold finishing is one sheet, the controller 350 goes to a step S230.

When the sheets P to be folded during the center-fold finishing are more than one sheet, at the step S210, the controller 350 determines whether or not the paper weight of the sheet P to be center-folded is not less than 62 g/m$^2$. The controller 350 determines that the paper weight of the sheet P to be center-folded is not less than 62 g/m$^2$, the controller 350 goes to a step S220. The controller 350 determines that the paper weight of the sheet P to be center-folded is less than 62 g/m$^2$, the controller 350 goes to a step S240.

On the other hand, when the sheet P to be folded is one sheet, at the step S230, the controller 350 determines whether or not the paper weight of the sheet P to be center-folded is not less than 62 g/m$^2$. The controller 350 determines that the paper weight of the sheet P to be center-folded is not less than 62 g/m$^2$, the controller 350 goes to the step S240. The controller 350 determines that the paper weight of the sheet P to be center-folded is less than 62 g/m$^2$, the controller 350 goes to a step S250.

When the sheets P to be folded during the center-fold finishing are more than one sheet and the paper weight of the sheet P to be center-folded is not less than 62 g/m$^2$, the friction force of the sheet P against the folding rollers 312*a*, 312*b* and the like is made smaller. Therefore, the controller 350 does not carry out the step-out prevention control in timing at which the folding blade 313 is pulled out of the nip position between the folding rollers 312*a*, 312*b* but controls the folding-rollers-driving member 314 to continuously rotate the folding rollers 312*a*, 312*b* at a constant speed. For example, the controller 350 controls the folding-rollers-driving member 314, a stepper motor, to rotate the folding rollers 312*a*, 312*b* at the rotation speed v1 (see FIG. 6).

When the sheets P to be folded during the center-fold finishing is one sheet and the paper weight of the sheet P to be center-folded is not less than 62 g/m$^2$ or the sheets P to be folded during the center-fold finishing are more than one sheet and the paper weight of the sheet P to be center-folded is less than 62 g/m$^2$, the friction force of the sheet P against the folding rollers 312*a*, 312*b* and the like is made larger. Therefore, the controller 350 carries out the step-out prevention control in timing at which the folding blade 313 is pulled out of the nip position between the folding rollers 312*a*, 312*b*.

When the sheets P to be folded during the center-fold finishing is one sheet and the paper weight of the sheet P to be center-folded is less than 62 g/m$^2$, the friction force of the sheet P against the folding rollers 312*a*, 312*b* and the like is made larger than that of a case of the step S240 where one of those conditions satisfies the step-out prevention control condition. Therefore, the controller 350 carries out the step-out prevention control to stop rotating the folding rollers 312*a*, 312*b* in timing at which the folding blade 313 is pulled out of the nip position between the folding rollers 312*a*, 312*b*. In this moment, the controller 350 controls the folding-rollers-driving member 314 to stop the rotation of the pair of folding rollers 312*a*, 312*b* by exciting the folding-rollers-driving member 314.

As described above, according to the second embodiment of the invention, since the controller 350 determines whether or not the step-out prevention control is carried out by taking into consideration the conditions of the number of sheet(s) P when performing the center-fold finishing on the sheet P and paper weight of the sheet P, it is possible to set the conditions of the number of sheet(s) P and the paper weight of the sheet P so that the friction force between the folding roller and the sheet and/or between the sheet and the folding blade can be made smaller and to carry out the step-out prevention control. This prevents the folding-rollers-driving member 314 from being stepped out of phase. Since the controller 350 controls the folding-rollers-driving member 314 to stop the rotation of the folding rollers 312*a*, 312*b* by exciting the folding-rollers-driving member 314, it is possible to prevent the folding-rollers-driving member 314 from being stepped out of phase more certainly and to restart the rotations of the folding rollers 312*a*, 312*b* rapidly.

Further, according to the second embodiment, since the controller 350 does not carry out the step-out prevention control when the sheets P to be folded during the center-fold finishing are more than one sheet, it is possible to avoid falling down the sheet(s) P when pulling the folding blade 313 out of the nip position between the folding rollers 312*a*, 312*b*.

It is to be noted that any technical scope of the claims and/or meaning of term(s) claimed in the claims are not limited to the description in the above-mentioned embodiments. It should be understood by those skilled in the art that various modifications, combinations, sub-combinations and alterations may occur depending on design requirements and other factors insofar as they are within the scope of the appended claims or the equivalents thereof. Although the number of sheet(s) P and the paper weight have been considered as the conditions for carrying out the step-out prevention control in the above embodiments, the invention is not limited thereto: For example, the controller 350 may determine whether or not the step-out prevention control is carried out by taking into consideration the image-forming conditions such as a size of the sheet P and thickness of the sheet P.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims. Although the controller 350 of the saddle-stitching apparatus 300 has performed the center-fold finishing on the sheet(s) in the above embodiments, the invention is not limited thereto: For example, a controller of the image-forming apparatus 100 or the like may perform the center-fold finishing on the sheet(s) as a main controller.

What is claimed is:

1. A sheet-processing apparatus comprising:

a pair of folding rollers that folds a sheet;

a thrusting member that thrusts the sheet to a position between the pair of folding rollers;

a driving member that drives the pair of folding rollers to rotate; and a control unit that controls the driving member, wherein after the thrusting member thrusts the sheet to the position between the pair of folding rollers, the control unit controls the driving member to stop rotation of the pair of folding rollers, at a timing at which the thrusting member is pulled out of the position between the pair of folding rollers.

2. The sheet-processing apparatus according to claim 1, wherein the driving member includes a stepper motor.

3. The sheet-processing apparatus according to claim 1, wherein the control unit controls the driving member to stop the rotation of the pair of folding rollers by exciting the driving member when the thrusting member is pulled out of the position between the pair of folding rollers.

4. A sheet-processing apparatus comprising:

a pair of folding rollers that folds a sheet;

a thrusting member that thrusts the sheet to a position between the pair of folding rollers;

a driving member that drives the pair of folding rollers to rotate; and a control unit that controls the driving member, wherein the control unit determines whether or not to perform step-out prevention control based on an image-forming condition, the step-out prevention control comprising controlling the driving member to stop or decelerate rotation of the pair of folding rollers at a timing at which the thrusting member is pulled out of the position between the pair of folding rollers, wherein after the thrusting member thrusts the sheet to the position between the pair of folding rollers, the control unit controls the driving member to stop or decelerate the rotation of the pair of folding rollers, at the timing at which the thrusting member is pulled out of the position between the pair of folding rollers, in a case in which the control unit has determined to perform the step-out prevention control, and wherein after the thrusting member thrusts the sheet to the position between the pair of folding rollers, the control unit does not control the driving member to stop or decelerate the rotation of the pair of folding rollers, at the timing at which the thrusting member is pulled out of the position between the pair of folding rollers, in a case in which the control unit has determined not to perform the step-out prevention control.

5. The sheet-processing apparatus according to claim 4, wherein the image-forming condition includes one of a number of sheets to be folded and paper weight of the sheet.

6. The sheet-processing apparatus according to claim 4, wherein the image-forming condition includes both of a number of sheets to be folded and paper weight of the sheet.

7. An image-forming system comprising:

an image-forming apparatus that forms an image on a sheet; and a sheet-processing apparatus that performs a sheet processing on the sheet on which the image is formed, wherein the sheet-processing apparatus comprises:

a pair of folding rollers that folds the sheet;

a thrusting member that thrusts the sheet to a position between the pair of folding rollers;

a driving member that drives the pair of folding rollers to rotate; and a control unit that controls the driving member, wherein after the thrusting member thrusts the sheet to the position between the pair of folding rollers, the control unit controls the driving member to stop the rotation of the pair of folding rollers, at a timing at which the thrusting member is pulled out of the position between the pair of folding rollers.

8. The image-forming system according to claim 7, wherein the driving member includes a stepper motor.

9. The image-forming system according to claim 7, wherein the control unit controls the driving member to stop the rotation of the pair of folding rollers by exciting the driving member when the thrusting member is pulled out of the position between the pair of folding rollers.

10. An image-forming system comprising:

an image-forming apparatus that forms an image on a sheet; and a sheet-processing apparatus that performs a sheet processing on the sheet on which the image is formed, wherein the sheet-processing apparatus contains:

a pair of folding rollers that folds the sheet;

a thrusting member that thrusts the sheet to a position between the pair of folding rollers;

a driving member that drives the pair of folding rollers to rotate; and a control unit that controls the driving member, wherein the control unit determines whether or not to perform step-out prevention control based on an image-forming condition, the step-out prevention control comprising controlling the driving member to stop or decelerate rotation of the pair of folding rollers at a timing at which the thrusting member is pulled out of the position between the pair of folding rollers, wherein after the thrusting member thrusts the sheet to the position between the pair of folding rollers, the control unit controls the driving member to stop or decelerate the rotation of the pair of folding rollers, at the timing at which the thrusting member is pulled out of the position between the pair of folding rollers, in a case in which the control unit has determined to perform the step-out prevention control, and wherein after the thrusting member thrusts the sheet to the position between the pair of folding rollers, the control unit does not control the driving member to stop or decelerate the rotation of the pair of folding rollers, at the timing at which the thrusting member is pulled out of the position between the pair of folding rollers, in a case in which the control unit has determined not to perform the step-out prevention control.

11. The image-forming system according to claim 10, wherein the image-forming condition includes one of a number of sheets to be folded and paper weight of the sheet.

12. The image-forming system according to claim 10, wherein the image-forming condition includes both of a number of sheets to be folded and paper weight of the sheet.

* * * * *